US011993432B1

(12) United States Patent
Polosajian

(10) Patent No.: US 11,993,432 B1
(45) Date of Patent: May 28, 2024

(54) STORAGE CONTAINER WITH BUILT-IN INFLATABLE CUSHION

(71) Applicant: Leo Polosajian, Reseda, CA (US)

(72) Inventor: Leo Polosajian, Reseda, CA (US)

( * ) Notice: Subject to any disclaimer, the term of this patent is extended or adjusted under 35 U.S.C. 154(b) by 0 days.

(21) Appl. No.: 18/161,222

(22) Filed: Jan. 30, 2023

(51) Int. Cl.
*B65D 81/03* (2006.01)
*B65B 5/04* (2006.01)
*B65B 55/00* (2006.01)
*B65D 5/50* (2006.01)

(52) U.S. Cl.
CPC ..... *B65D 5/5028* (2013.01); *B65B 5/04* (2013.01); *B65B 55/00* (2013.01)

(58) Field of Classification Search
CPC .... B65D 5/5028; B65D 81/03; B65D 81/052; B65B 5/04
USPC ..... 206/522; 383/3
See application file for complete search history.

(56) References Cited

U.S. PATENT DOCUMENTS 4,905,835 A * 3/1990 Pivert ..... B65D 81/052 383/3
5,217,131 A * 6/1993 Andrews ..... B65D 81/052 383/3
5,769,232 A * 6/1998 Cash ..... B65D 81/052 383/3
5,884,768 A * 3/1999 Fox ..... A45C 13/02 206/320
6,431,361 B1 * 8/2002 Wolf ..... B65D 81/052 206/592
6,957,739 B1 * 10/2005 Stephenson ..... A47F 3/14 206/443
2001/0013519 A1 * 8/2001 Liebold ..... A45C 13/021 190/125
2004/0149618 A1 * 8/2004 Otaki ..... B65D 81/052 206/521
2005/0006271 A1 * 1/2005 Nakagawa ..... B65D 81/052 206/521
2005/0061409 A1 * 3/2005 Chung ..... A45C 7/0081 383/3
2006/0108256 A1 * 5/2006 Bussey, III ..... B65D 5/606 53/472
2007/0221530 A1 * 9/2007 Lee ..... B65D 81/052 206/522
2010/0084309 A1 * 4/2010 Sielski ..... B65D 5/18 229/109
2014/0224699 A1 * 8/2014 Smith ..... B65B 5/06 206/522

* cited by examiner

*Primary Examiner* — Luan K Bui
(74) *Attorney, Agent, or Firm* — Lewis Roca Rothgerber Christie LLP

(57) ABSTRACT

A storage container includes a box having a first sidewall, a second sidewall coupled to a first edge of the first sidewall, a third sidewall coupled to a second edge of the first sidewall, a fourth sidewall coupled to the second sidewall and the third sidewall, four lower flaps hingedly coupled to lower ends of the first, second, third, and fourth sidewalls, and four upper flaps hingedly coupled to upper ends of the first, second, third, and fourth sidewalls. The storage container also includes at least one inflatable bag coupled to an inner surface of at least one of the first sidewall, the second sidewall, the third sidewall, the fourth sidewall, the four lower flaps, or the four upper flaps.

17 Claims, 5 Drawing Sheets

STORAGE CONTAINER WITH BUILT-IN INFLATABLE CUSHION

BACKGROUND

1. Field

The present disclosure relates to various embodiments of a storage container having a built-in inflatable cushion.

2. Detailed Description

Moving boxes are typically formed of cardboard. Although cardboard is lightweight and relatively durable, it provides little cushion or protection for the contents stored in the moving box. Accordingly, people typically wrap their contents in bubble wrap, film, and/or packing paper to provide additional protection. Alternatively, people may fill the box with packing "peanuts." However, bubble wrap, film, packing paper, and packing peanuts are wasteful, harmful to the environment, and expensive. It is also time-consuming and labor intensive to wrap the storage contents and/or stuff the box with bubble, wrap, film, packing paper, or packing peanuts.

SUMMARY

The present disclosure relates to various embodiments of a storage container. In one embodiment, the storage container includes a box having a first sidewall, a second sidewall coupled to a first edge of the first sidewall, a third sidewall coupled to a second edge of the first sidewall, a fourth sidewall coupled to the second sidewall and the third sidewall, four lower flaps hingedly coupled to lower ends of the first, second, third, and fourth sidewalls, and four upper flaps hingedly coupled to upper ends of the first, second, third, and fourth sidewalls. The storage container also includes at least one inflatable bag coupled to an inner surface of at least one of the first sidewall, the second sidewall, the third sidewall, the fourth sidewall, the four lower flaps, or the four upper flaps.

The storage container may include a first inflatable bag connected to an inner surface of the first sidewall, a second inflatable bag connected to an inner surface of the second sidewall, a third inflatable bag connected to an inner surface of the third sidewall, a fourth inflatable bag connected to an inner surface of the fourth sidewall.

The storage container may also include a fifth inflatable bag connected to an inner surface of one of the four lower flaps.

The storage container may further include a sixth inflatable bag connected to an inner surface of another one of the four upper flaps.

The inflatable bag may coupled to the inner surface with an adhesive.

At least one of the first inflatable bag, the second inflatable bag, the third inflatable bag, the fourth inflatable bag, the fifth inflatable bag, or the sixth inflatable bag may include two or more pockets.

The at least one inflatable bag may include a valve, such as an oral inflation valve.

The storage container may also include a hand pump configured to inflate the at least one inflatable bag.

The storage container may include a motorized pump configured to inflate the at least one inflatable bag.

The box container be formed of cardboard.

The storage container may further include a partition configured to divide an interior of the box into at least two chambers.

The storage container may include at least a second inflatable bag on an outer surface of the partition.

The partition may have a grid shape or a cross shape.

The present disclosure also relates to various embodiments of a method of packing at least one object for transport. In one embodiment, the method includes erecting a box including a first sidewall, a second sidewall coupled to a first edge of the first sidewall, a third sidewall coupled to a second edge of the first sidewall, and a fourth sidewall coupled to the second sidewall and the third sidewall. The method also includes closing four lower flaps of the box hingedly coupled to lower ends of the first, second, third, and fourth sidewalls, inserting the at least one object into the interior compartment of the box, inflating at least one inflatable cushion coupled to an inner surface of at least one of the first sidewall, the second sidewall, the third sidewall, the fourth sidewall, the four lower flaps, or the four upper flaps. Following the inflating of the at least one inflatable bag, the inflatable bag extends into an interior compartment of the box. The method also includes closing four upper flaps of the box hingedly coupled to upper ends of the first, second, third, and fourth sidewalls.

Inflating the at least one inflatable cushion may include blowing into an oral inflation valve in the at least one inflatable cushion or pumping air into the least one inflatable cushion utilizing a pump.

The method may also include inserting at least one partition into the interior compartment of the box and inflating at least one second inflatable cushion coupled to the at least one partition.

The method may include unpacking the at least one object from the box, and deflating the at least one inflatable cushion, such as by opening a dump valve on the at least one inflatable cushion.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable storage container or a method of packing materials for transport.

BRIEF DESCRIPTION OF THE DRAWINGS

The features and advantages of embodiments of the present disclosure will be better understood by reference to the following detailed description when considered in conjunction with the drawings. The drawings are not necessarily drawn to scale.

DETAILED DESCRIPTION

The present disclosure relates to various embodiments of a storage container (e.g., a box) having a built-in inflatable cushion, and methods of packing at least one object for transport (e.g., shipping) utilizing the storage container having the built-in inflatable cushion. The storage containers of the present disclosure are configured to eliminate or at least reduce the amount of disposable packing materials that are costly, wasteful, and harmful to the environment, such as bubble wrap, film, packing paper, and packing "peanuts."

Figure 1A:
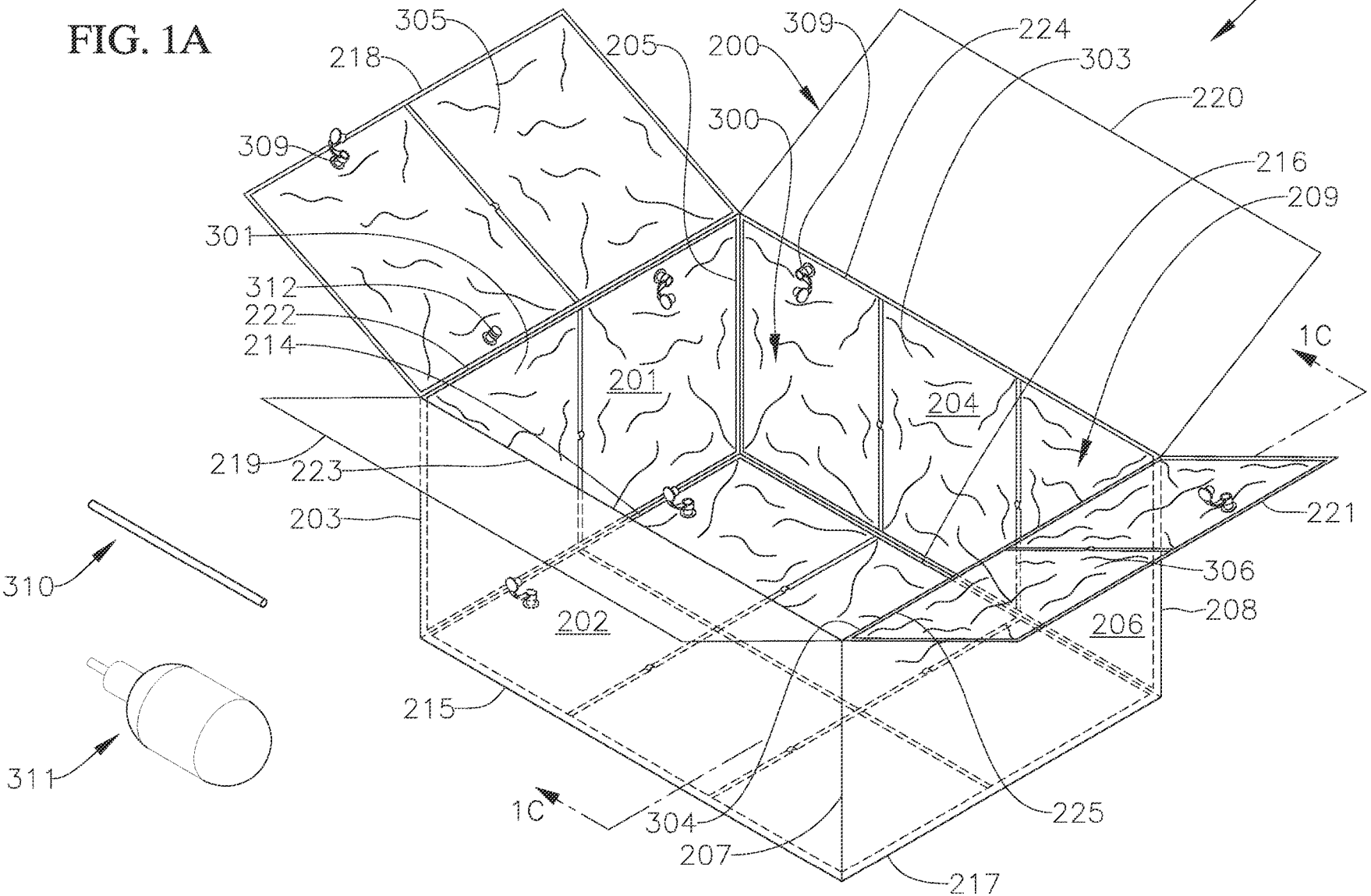
FIGS. 1A-1B are perspective views of a storage container having a built-in inflatable cushion according to one embodiment of the present disclosure showing the inflatable cushion in a deflated configuration and an inflated configuration, respectively.
Figure 1B:
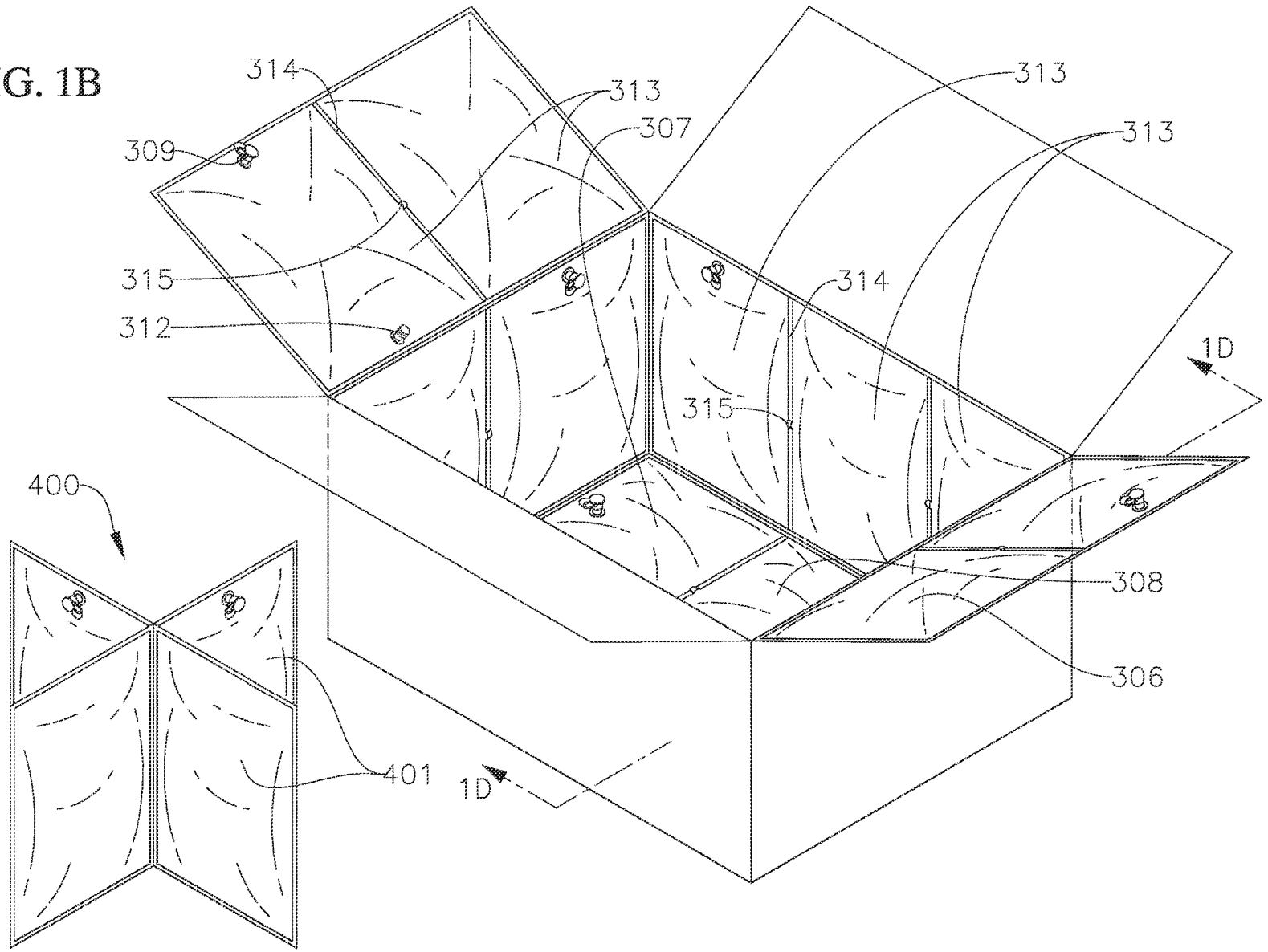
Figure 1C:
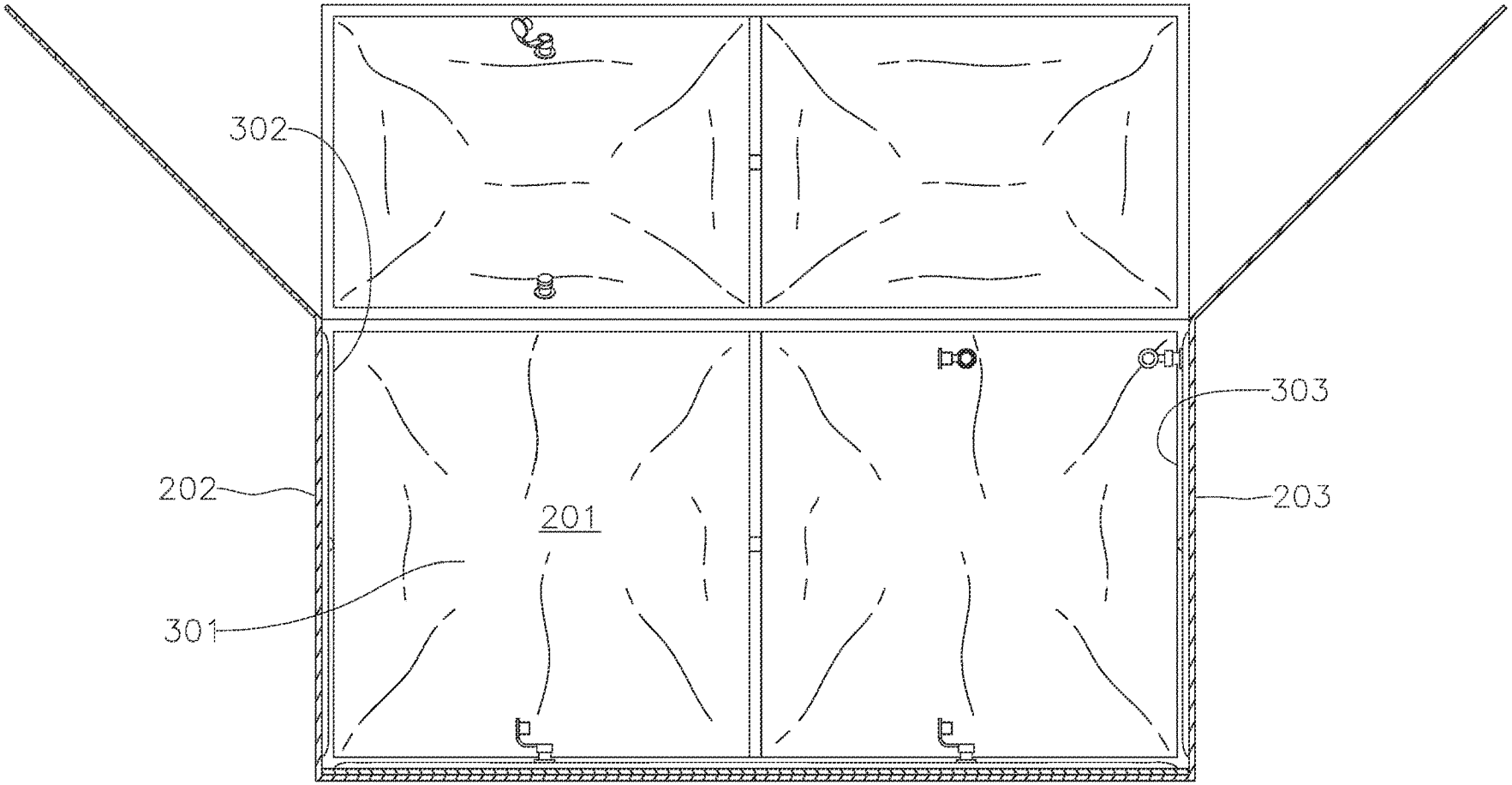
FIGS. 1C-1D are cross-sectional views of the embodiment of the storage container illustrated in FIGS. 1A-1B, respectively.
Figure 1D:
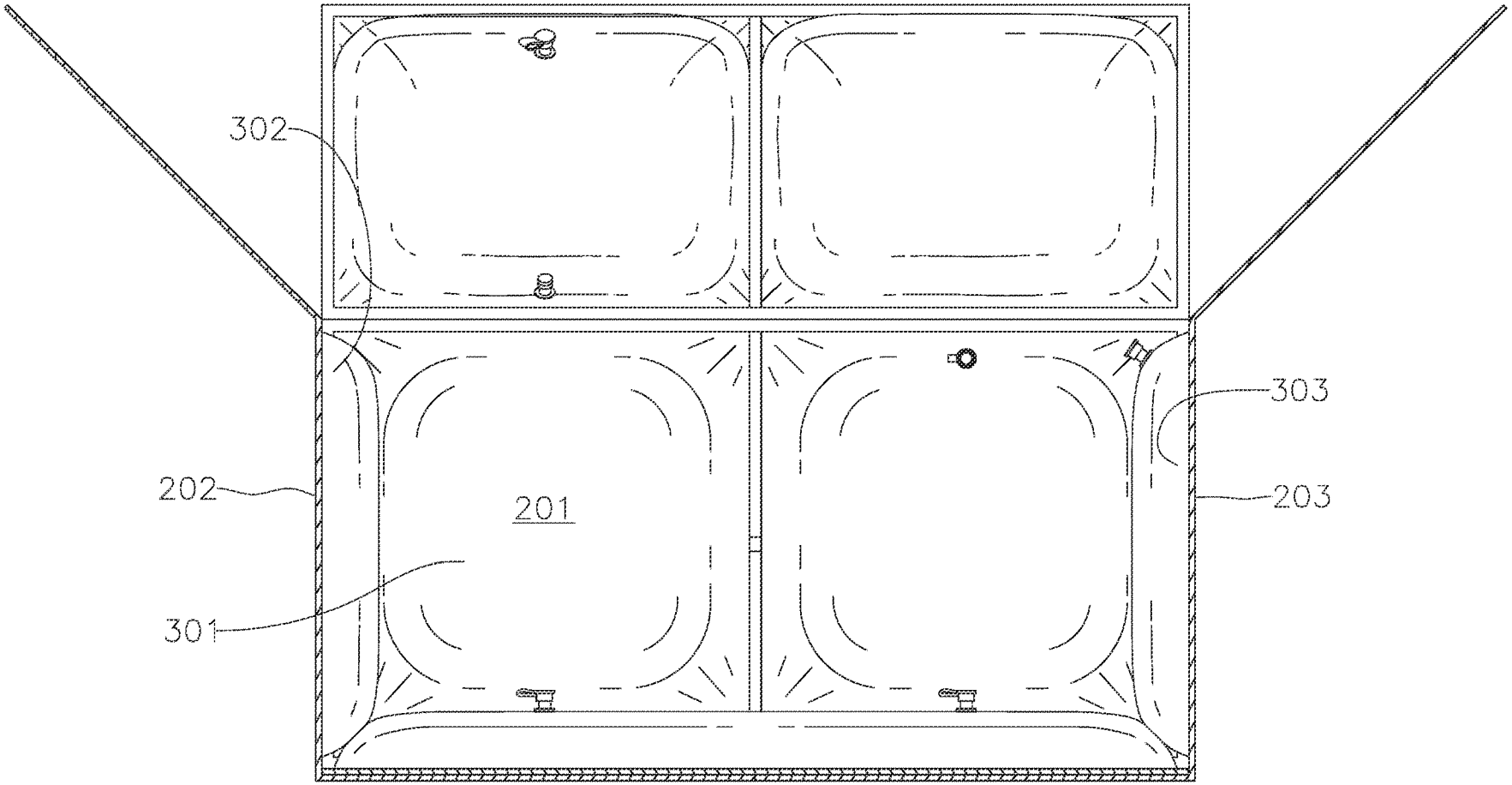

With reference now to FIGS. 1A-1C, a storage container 100 according to one embodiment of the present disclosure includes a box 200 and at least one inflatable cushion assembly or air bag assembly 300 coupled to an interior of the box 200. In the illustrated embodiment, the box 200 includes a first sidewall 201 (e.g., a first planar rectangular or square sidewall), a second sidewall 202 coupled (e.g., hingedly coupled via a living hinge) to a first edge 203 of the first sidewall 201, a third sidewall 204 coupled (e.g., hingedly coupled via a living hinge) to a second edge 205 of the first sidewall 201 opposite to the first edge 203 of the first sidewall 201, and a fourth sidewall 206 coupled (e.g., hingedly coupled via a living hinge) at opposite edges 207, 208 to the second sidewall 202 and the third sidewall 204, respectively. The box 200 is configured to move between a collapsed (stored) configuration and an erect configuration. In the collapsed configuration, the sidewalls 201, 202, 204, 206 are folded flat against each other. In the erect configuration, the sidewalls 201, 202, 204, 206 of the box 200 define an interior compartment 209 configured to store one or more items. In the illustrated embodiment, when the box 200 is in the erect configuration, the first sidewall 201 and the fourth sidewall 206 are parallel (or substantially parallel) and opposite to each other, and the second sidewall 202 and the third sidewall 204 are parallel (or substantially parallel) and opposite to each other. In the illustrated embodiment, the box 200 is a cubic box, although in one or more embodiments the box 200 may have any other suitable shape, such as any other suitable prismatic shape.

Additionally, in the illustrated embodiment, the box 200 includes four lower flaps 210, 211, 212, 213 hingedly coupled (e.g., hingedly coupled via a living hinge) to lower edges 214, 215, 216, 217 of the sidewalls 201, 202, 204, 206, respectively (i.e., a first lower flap 210 hingedly coupled to a lower edge 214 of the first sidewall 201, a second lower flap 211 hingedly coupled to a lower edge 215 of the second sidewall 202, a third lower flap 212 hingedly coupled to a lower edge 216 of the third sidewall 204, and a fourth lower flap 213 hingedly coupled to a lower edge 217 of the fourth sidewall 206), and four upper flaps 218, 219, 220, 221 hingedly coupled (e.g., hingedly coupled via a living hinge) to upper edges 222, 223, 224, 225 of the 201, 202, 204, 206, respectively (i.e., a first upper flap 218 hingedly coupled to an upper edge 222 of the first sidewall 201, a second upper flap 219 hingedly coupled to an upper edge 223 of the second sidewall 202, a third upper flap 220 hingedly coupled to an upper edge 224 of the third sidewall 204, and a fourth upper flap 221 hingedly coupled to an upper edge 225 of the fourth sidewall 206). In one or more embodiments, the box 200 is a corrugated cardboard box, although in one or more embodiments the box 200 may be formed of any other suitable material, such as any other paper product or a polymer material.

In the illustrated embodiment, the inflatable cushion assembly 300 includes a first inflatable cushion 301 connected to an inner surface of the first sidewall 201, a second inflatable cushion 302 connected to an inner surface of the second sidewall 202, a third inflatable cushion 303 connected to an inner surface of the third sidewall 204, and a fourth inflatable cushion 304 connected to an inner surface of the fourth sidewall 206. The first, second, third, and fourth inflatable cushions 301, 302, 303, 304 may be connected to the inner surfaces of the sidewalls 201, 202, 204, 206, respectively, in any suitable manner, such as with adhesive (e.g., adhesive coupling a periphery of each of the first, second, third, and fourth inflatable cushions 301, 302, 303, 304 to the inner surfaces of the sidewalls 201, 202, 204, 206, respectively). In one or more embodiments, the first, second, third, and fourth inflatable cushions 301, 302, 303, 304 may be interconnected.

Additionally, in one or more embodiments, the inflatable cushion assembly 300 may a fifth inflatable cushion 305 and a sixth inflatable cushion 306 coupled to two opposing upper flaps 218, 220 or 219, 221 (e.g., the fifth inflatable cushion 305 may be coupled to the first upper flap 218 and the sixth inflatable cushion 306 may be coupled to the third upper flap 220, or the fifth inflatable cushion 305 may be coupled to the second upper flap 219 and the sixth inflatable cushion 306 may be coupled to the fourth upper flap 221).

Furthermore, in one or more embodiments, the inflatable cushion assembly 300 may include a seventh inflatable cushion 307 and an eight inflatable cushion 308 coupled to two opposing lower flaps 210, 212 or 211, 213 (e.g., the seventh inflatable cushion 307 may be coupled to the first lower flap 210 and the eighth inflatable cushion 308 may be coupled to the third lower flap 212, or the seventh inflatable cushion 307 may be coupled to the second lower flap 211 and the eighth inflatable cushion 308 may be coupled to the fourth lower flap 213). The fifth, sixth, seventh, and eighth inflatable cushions 305, 306, 307, 308 may be connected to inner surfaces of the upper flaps 218, 219, 220, 221 and to inner surfaces of the lower flaps 210, 211, 212, 213 in any suitable manner, such as with adhesive (e.g., adhesive coupling a periphery of each of the fifth, sixth, seventh, and eighth inflatable cushions 305, 306, 307, 308 to the inner surfaces of the upper flaps 218, 219, 220, 221 and to the inner surfaces of the lower flaps 210, 211, 212, 213, respectively).

In the illustrated embodiment, each of the inflatable cushions 301-308 includes a valve 309, such as an oral inflation valve or a one-way valve. In one or more embodiments, the inflatable cushion assembly 300 may also include a straw 310 (i.e., a stem) and/or a pump 311 (e.g., a hand pump such as a squeeze bulb pump, or a motorized pump) configured to enable a user to inflate the inflatable cushions 301-308. In one or more embodiments, each of the inflatable cushions 301-308 may include a deflation valve 312 (e.g., a dump valve) configured to enable a user to remove the air from the inflatable cushions 301-308 and thereby deflate the inflatable cushions 301-308. In this manner, the box 200 may be collapsed and stored for later reuse. In one or more embodiments, the inflatable cushions 301-308 may not include separate inflation and deflation valves (e.g., each of the inflatable cushions 301-308 may include a combination inflation/deflation valve).

In one or more embodiments, one or more of the inflatable cushions 301-308 may include a number of interconnected pockets 313. For instance, in one or more embodiments, each of the first, second, third, and fourth inflatable cushions 301-304 may include an array of two or more pockets 313, such as two or more vertically extending pockets 313 that are arranged side-by-side, a grid of pockets 313 arranged in rows and columns, or any other suitable configuration.

Adjacent pockets 313 may be separated by a line of adhesive 314 connecting inner and outer surfaces of the inflatable cushions 301-304 to each other and/or to the inner surfaces of the sidewalls 201, 202, 204, 206. The inflatable bags 301-304 are configured not to inflate along the line(s)) of adhesive 314. The line of adhesive 314 may include an opening 315 that permits air to flow between the pockets 313 such that a single valve 309 may be utilized to inflate each of the pockets 313. The line(s) of adhesive 314 and the pockets 313 are configured to reduce the difference between the amount that the central portions of the inflatable bags 301-304 extend into the interior compartment 209 and the amount that the peripheral portions of the inflatable bags 301-304 extend into the interior compartment 209 compared to an embodiment in which the inflatable cushions 301-304 were a single pocket. Otherwise, the central portions of the inflatable cushions 301-304 may extend significantly further into the interior compartment 209 of the box 200 than the peripheral portions of the inflatable cushions 301-304, which may cause the inflatable cushions 301-304 to apply varying amounts of pressure on the object(s) in the box 200 (and thus inadequately protect the object(s) against damage) and/or make properly packing the objects in the box 200 difficult. In one or more embodiments, the inflatable cushions 301-308 may be formed of plastic, such as polycarbonate, polyethylene (e.g., Polyethylene Terephthalate (PETE or PET), polypropylene, Acrylonitrile-Butadiene-Styrene (ABS), and/or polyvinyl chloride (PVC).

In one or more embodiments, the storage container 100 may also include one or more partitions 400 that are configured to be inserted into the interior compartment 209 of the box 200 and to divide the interior compartment 209 into two or more interior chambers 238. In one or more embodiments, the partition 400 may be a flat planar partition configured to divide the interior compartment 209 into two interior chambers 238, a cross-shaped partition 400 configured to divide the interior compartment 209 into four interior chambers 238, or a grid-shaped partition 400 configured to divide the interior compartment 209 into a grid of interior chambers 238 arranged in rows and columns. In one or more embodiments, the partition 400 may be made of the same material as the box 200 (e.g., the partition 400 may be corrugated cardboard) or the partition 400 may be made of a different material than the box 200. Additionally, in one or more embodiments, the partition 400 may include one or more inflatable cushions 401. The inflatable cushion(s) 401 of the partition 400 may be the same as or similar to the inflatable cushions 301-308 on the box 200.

Figure 2:
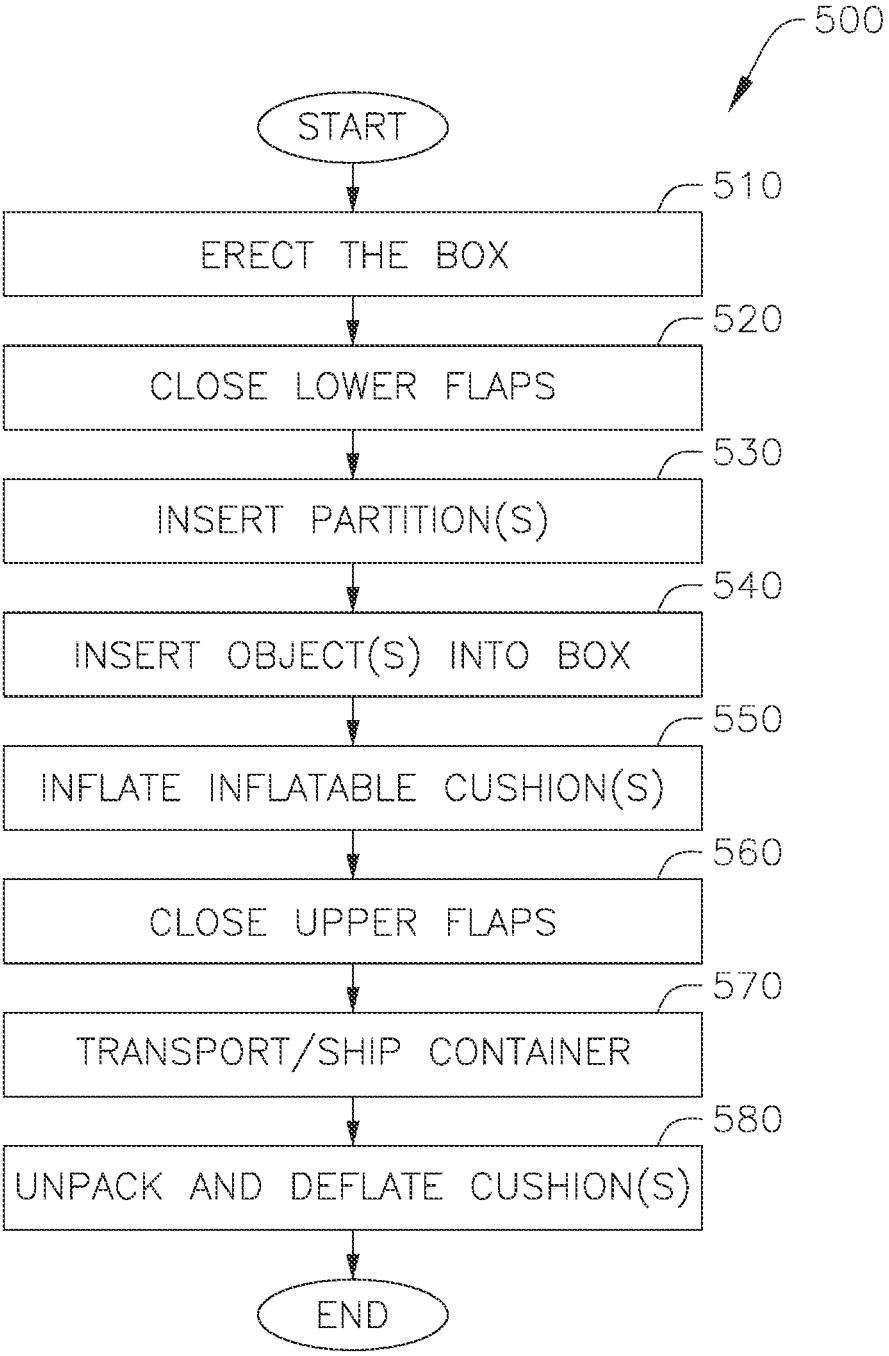
FIG. 2 is a flowchart illustrating tasks of a method of packing at least one object for transport according to one embodiment of the present disclosure.

With reference now to FIG. 2, a method 500 of packing at least one object for transport (e.g., shipping) includes a task 510 of erecting a box comprising a first sidewall, a second sidewall coupled to a first edge of the first sidewall, a third sidewall coupled to a second edge of the first sidewall, and a fourth sidewall coupled to the second sidewall and the third sidewall. The box may be the same as or similar to the box 200 illustrated in FIGS. 1A-1C. Following task 510, the sidewalls are mutually orthogonal (or substantially mutually orthogonal) and the sidewalls define an interior compartment. In one or more embodiments, the box may have any other suitable configuration, such as any other suitable prismatic shape.

In the illustrated embodiment, the method 500 also includes a task 520 of closing four lower flaps of the box that are hingedly coupled to lower ends of the first, second, third, and fourth sidewalls, respectively.

In the illustrated embodiment, the method 500 also includes a task 530 of inserting at least one partition into the interior chamber of the box. As described above, the partition may include one or more inflatable cushions. Following the task 530 of inserting the one or more partitions into the interior chamber of the box, the interior chamber is segmented or divided into two or more chambers. In one or more embodiments, depending for example on the configuration (e.g., size, shape, and/or material) of the one or more objects that will be stored in the box, the method 500 may not include the task 530 of inserting at least one partition into the interior chamber of the box.

In the illustrated embodiment, the method 500 also includes a task 540 of inserting the at least one object into the interior compartment of the box that was erected in task 510 or, if the divider was inserted into the interior compartment in task 530, into one or more of the chambers. The one or more objects may include any suitable type or kind of object that need to be protected against damage during shipping or transportation, such as glassware, serveware, dinnerware, drinkware, etc.

In the illustrated embodiment, the method 500 also includes a task 550 of inflating at least one inflatable cushion coupled to an inner surface of at least one of the first sidewall, the second sidewall, the third sidewall, the fourth sidewall, the four lower flaps, or the four upper flaps. If the method 500 includes the task 530 of inserting at least one partition into the interior chamber of the box, the task 550 may include inflating at least one inflatable cushion of the partition. The task 550 of inflating the at least one inflatable cushion may be performed in any suitable manner, such as blowing into an oral inflation valve (directly or via a straw) on the inflatable cushion or utilizing a pump (e.g., a manual pump such as a squeeze bulb pump, or a motorized pump). Following the task 550 of inflating the at least one inflatable bag, the inflatable bag(s) extend(s) into the interior compartment of the box (or into one or more of the chambers if the divider was inserted into the interior compartment in task 530) and press(es) against (or is in close proximity to) the one or more objects that were inserted into the interior compartment of the box in task 540. In this manner, the inflatable cushion(s) is/are configured to protect the one or more objects against damage during transport or shipping. In one or more embodiments, the task 550 of inflating the cushion(s) may be performed before the task 540 of inserting the object(s) into the interior compartment of the box.

In the illustrated embodiment, the method 500 also includes a task 560 of closing four upper flaps of the box hingedly coupled to upper ends of the first, second, third, and fourth sidewalls, respectively, to close the box. Following task 560, the container is ready for transport or shipping.

In the illustrated embodiment, the method 500 also includes a task 570 of transporting or shipping the container containing the one or more objects. During the task 570 of transporting or shipping the container, the inflated cushion(s) protect the object(s) stored in the box against damage.

Following the task 570, the method 500 includes a task 580 of unpacking the one or more objects from the box. In one or more embodiments, the task 580 of unpacking the box may include deflating the cushions. The task 580 of deflating the cushions may be performed in any suitable manner, such as by opening one or more dump valves on the cushions to release the air contained therein. Once the cushions have been deflated, the box may be collapsed (e.g., by folding the sidewalls flat against each other) and stored for later reuse. Accordingly, because the inflatable cushions are integral with the box, the container of the present disclosure eliminates or at least reduces the use of conventional packing materials, such as bubble wrap, film, packing paper, and packing "peanuts," which are expensive, wasteful, and harmful to the environment.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, and equivalents thereof.

What is claimed is:

1. A storage container, comprising:

a box comprising:

a first sidewall;

a second sidewall coupled to a first edge of the first sidewall;

a third sidewall coupled to a second edge of the first sidewall;

a fourth sidewall coupled to the second sidewall and the third sidewall;

four lower flaps hingedly coupled to lower ends of the first, second, third, and fourth sidewalls; and four upper flaps hingedly coupled to upper ends of the first, second, third, and fourth sidewalls;

at least one inflatable bag coupled to an inner surface of at least one of the first sidewall, the second sidewall, the third sidewall, the fourth sidewall, the four lower flaps, or the four upper flaps;

a partition configured to divide an interior of the box into at least two chambers; and at least a second inflatable bag coupled to an outer surface of the partition, wherein the at least second inflatable bag coupled to the partition is separate from the at least one inflatable bag coupled to the box.

2. The storage container of claim 1, wherein the at least one inflatable bag comprises:

a first inflatable bag connected to an inner surface of the first sidewall;

a second inflatable bag connected to an inner surface of the second sidewall;

a third inflatable bag connected to an inner surface of the third sidewall; and a fourth inflatable bag connected to an inner surface of the fourth sidewall.

3. The storage container of claim 2, wherein the at least one inflatable bag further comprises a fifth inflatable bag connected to an inner surface of one of the four lower flaps.

4. The storage container of claim 3, wherein the at least one inflatable bag further comprises a sixth inflatable bag connected to an inner surface of another one of the four upper flaps.

5. The storage container of claim 1, wherein the at least one inflatable bag is coupled to the inner surface with an adhesive.

6. The storage container of claim 4, wherein at least one of the first inflatable bag, the second inflatable bag, the third inflatable bag, the fourth inflatable bag, the fifth inflatable bag, or the sixth inflatable bag comprises a plurality of pockets.

7. The storage container of claim 1, wherein the at least one inflatable bag comprises a valve.

8. The storage container of claim 7, wherein the valve is an oral inflation valve.

9. The storage container of claim 1, further comprising a hand pump configured to inflate the at least one inflatable bag.

10. The storage container of claim 1, further comprising a motorized pump configured to inflate the at least one inflatable bag.

11. The storage container of claim 1, wherein the box comprises cardboard.

12. The storage container of claim 1, wherein the partition has a grid shape.

13. The storage container of claim 1, wherein the partition has a cross shape.

14. A method of packing at least one object for transport, the method comprising:

erecting a box comprising a first sidewall, a second sidewall coupled to a first edge of the first sidewall, a third sidewall coupled to a second edge of the first sidewall, and a fourth sidewall coupled to the second sidewall and the third sidewall;

closing four lower flaps of the box hingedly coupled to lower ends of the first, second, third, and fourth sidewalls;

inserting the at least one object into the interior compartment of the box;

inflating at least one inflatable bag coupled to an inner surface of at least one of the first sidewall, the second sidewall, the third sidewall, the fourth sidewall, the four lower flaps, or four upper flaps hingedly coupled to upper ends of the first, second, third, and fourth sidewalls, wherein following the inflating of the at least one inflatable bag, the at least one inflatable bag extends into an interior compartment of the box;

inserting at least one partition into the interior compartment of the box;

inflating at least one second inflatable bag coupled to the at least one partition, wherein the at least second inflatable bag coupled to the partition is separate from the at least one inflatable bag coupled to the box; and closing the four upper flaps of the box.

15. The method of claim 14, wherein the inflating the at least one inflatable bag comprises blowing into an oral inflation valve in the at least one inflatable bag or pumping air into the least one inflatable bag utilizing a pump.

16. The method of claim 14, further comprising:

unpacking the at least one object from the box; and deflating the at least one inflatable bag.

17. The method of claim 16, wherein the deflating the at least one inflatable bag comprises opening a dump valve on the at least one inflatable bag.

* * * * *